US009177712B2

(12) United States Patent
Chen

(10) Patent No.: US 9,177,712 B2
(45) Date of Patent: Nov. 3, 2015

(54) TRANSFORMER

(75) Inventor: Min-Chiao Chen, Hsinchu Hsien (TW)

(73) Assignee: MStar Semiconductor, Inc., Hsinchu Hsien (TW)

( * ) Notice: Subject to any disclaimer, the term of this patent is extended or adjusted under 35 U.S.C. 154(b) by 325 days.

(21) Appl. No.: 13/010,857

(22) Filed: Jan. 21, 2011

(65) Prior Publication Data

US 2012/0001718 A1 Jan. 5, 2012

(30) Foreign Application Priority Data

Jun. 30, 2010 (TW) ..... 99121591 A

(51) Int. Cl.
*H01F 5/00* (2006.01)
*H01F 27/28* (2006.01)

(52) U.S. Cl.
CPC .... *H01F 27/2804* (2013.01); *H01F 2027/2809* (2013.01)

(58) Field of Classification Search
CPC ..... H01F 5/00; H01F 27/28
USPC ..... 336/200, 232
See application file for complete search history.

(56) References Cited

U.S. PATENT DOCUMENTS

| | | | | |
|---|---|---|---|---|
| 7,171,739 | B2 * | 2/2007 | Yang et al. | 29/602.1 |
| 2004/0217839 | A1 * | 11/2004 | Haaren et al. | 336/200 |
| 2007/0120637 | A1 * | 5/2007 | Ezzeddine | 336/200 |
| 2008/0284553 | A1 * | 11/2008 | Lim et al. | 336/200 |
| 2009/0027152 | A1 * | 1/2009 | Gianesello | 336/225 |
| 2010/0060402 | A1 * | 3/2010 | Chen | 336/200 |
| 2010/0164667 | A1 * | 7/2010 | Ho-Hsiang | 336/137 |

* cited by examiner

*Primary Examiner* — Tsz Chan
(74) *Attorney, Agent, or Firm* — Edell, Shapiro & Finnan, LLC

(57) ABSTRACT

A transformer includes a first planar coil having two input ends, with a distance being between the two input ends; and a second planar coil, having two output ends. The two input ends correspond to two points on relative positions of the second planar coil, and a coil path distance of the two points on the second planar coil is equal to the distance.

11 Claims, 7 Drawing Sheets

TRANSFORMER

CROSS REFERENCE TO RELATED PATENT APPLICATION

This patent application is based on Taiwan, R.O.C. patent application No. 099121591 filed on Jun. 30, 2010.

FIELD OF THE INVENTION

The present invention relates to a transformer, and more particularly, to a transformer capable of outputting output signals having equal energy and removing undesired signals.

BACKGROUND OF THE INVENTION

FIG. 1 is a schematic diagram of a configuration of a conventional in-chip transformer. The conventional transformer 10 comprises a primary coil 120 and a secondary coil 140. The primary coil 120 has two end points P1 and P2, and the secondary coil 140 also has two end points S1 and S2. In this example, the transformer 10 is a planar transformer, i.e., the primary coil 120 and the secondary coil 140 are planar coils and are on different planes, e.g., the primary coil 120 is right above or under the secondary coil 140. The transformer 10 can be employed as a balun. In the following description, the end point S1 of the secondary coil 140 is assumed to be coupled to ground, as an example.

Because the end point S1 of the secondary coil 140 is coupled to ground while the end point S2 is not coupled to ground, the end points S1 and S2 have different impedances. Because the transformer 10 is a planar transformer, and the points P1' and P2' are respectively right above or under the end points P1 and P2, the two end points P1 and P2 respectively correspond to two points P1' and P2' of the secondary coil 140. Referring to FIG. 1, the corresponding point P1' has a longer distance from the end point S2 compared to the distance between the corresponding point P2 and the end point S2. That is, signal transmission distances between the point P1' and the end point S2 and that between the corresponding point P2' and the end point S2 are not equal. Since the end points S1 and S2 have different impedance values, and the signal transmission distances between the corresponding point P1' and the end point S2 and that of the corresponding point P2' and the end point S2 are not equal, the two end points P1 and P2 of the secondary coil 120 respectively have different input impedances. Therefore, when input signals having equal energy are respectively inputted to the two end points P1 and P2 of the primary coil 120, two output signals have unequal energy at the end point S2 of the secondary coil 140, thereby creating a problem of unequal energy of the output signals of the transformer.

In addition, when the transformer 10 is used in a transmitter of a communication system, wherein circuits of the transmitter are non-ideal, on top of a to-be-transmitted signal, second-order harmonic signals of the to-be-transmitted signal are transmitted. When signal strength (energy) of the to-be-transmitted signal of the transmitter becomes larger, the signal strengths of the second-order harmonic signals become larger. Large second-order harmonic signals will cause interference to a circuit having an on-chip inductor, such as a voltage-controlled oscillator (VCO) where its output frequency may have undesired shift because of the interference; however, the conventional transformer described above is unable to remove the undesired signals.

Therefore, a transformer capable of outputting output signals having equal output signal strength and removing undesired signals (e.g., second-order harmonic signals) is in need.

SUMMARY OF THE INVENTION

An object of the present invention is to provide a transformer without unequal output signal energy and undesired signals.

According to an embodiment of the present invention, a transformer comprises a first planar coil, having two input ends, with a distance between the two input ends; and a second planar coil, having two output ends; wherein, the two input ends correspond to two points on relative positions of the second planar coil, and a coil path between the two points on the second planar coil is approximately equal to the distance.

According to another embodiment of the present invention, a transformer comprises a first coil, for inputting an input signal; a second coil, for generating an output signal corresponding to the input signal; and a filter circuit, for adjusting an impedance value of the transformer at a predetermined frequency to remove components of the output signal at the predetermined frequency; wherein, the filter circuit comprises a filter coil overlapped with one of the first coil and the second coil.

A conventional transformer is only used for energy conversion but not for removing undesired signals because it cannot output signals having equal energy. Therefore, a transformer that outputs signals having equal energy as well as removing undesired signals is provided.

The advantages and spirit related to the present invention can be further understood via the following detailed description and drawings. Meanwhile, the description and the drawings will not limit the scope of the invention.

DETAILED DESCRIPTION OF THE PREFERRED EMBODIMENT

Figure 1:
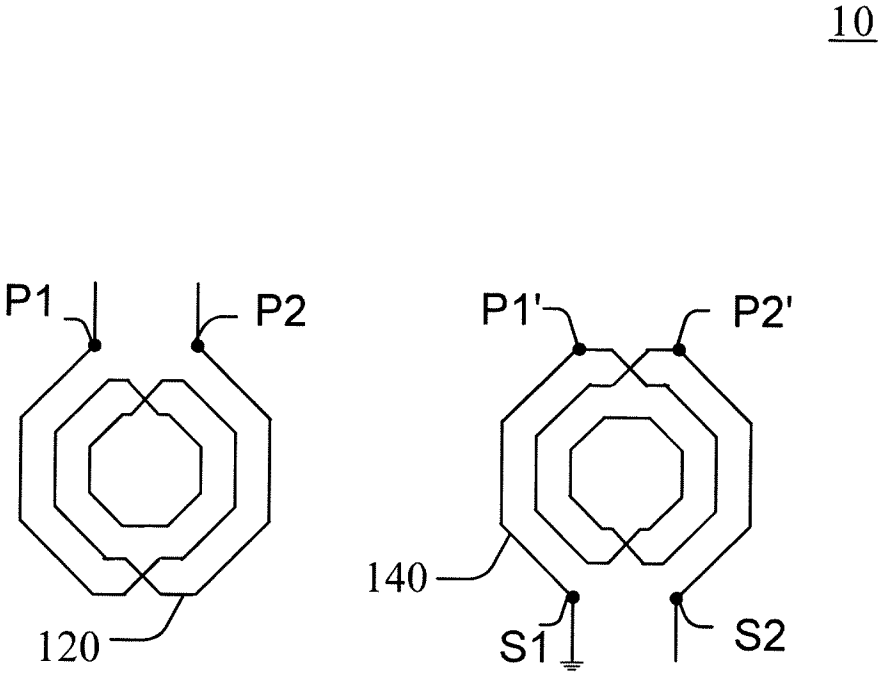
Figure 1 (Prior Art)
FIG. 1 is a schematic diagram of layout of a conventional in-chip transformer.
Figure 2:
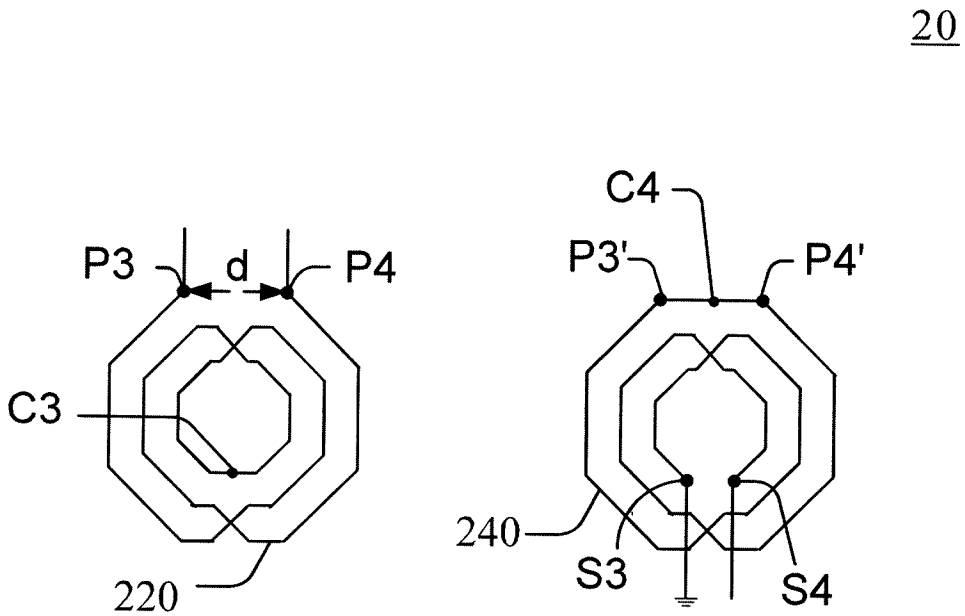
FIG. 2 is a schematic diagram of layout of a transformer of an embodiment of the present invention.

FIG. 2 is a schematic diagram of a configuration of a transformer in accordance with an embodiment of the present invention. The transformer 20 comprises a first coil 220 and a second coil 240. The first coil 220 has two end points P3 and P4, with a distance d between the end points P3 and P4. The second coil 240 has two end points S3 and S4. The transformer 20 can be employed as a balun. When the transformer 20 is a balun, the end point S3 of the first coil 240 is coupled to a fixed voltage, for example, the end point S3 is coupled to ground. In the following description, the end point S3 of the second coil 240 is coupled to ground.

The first coil 220 and the second coil 240 are designed to wind in a way that the two end points P3 and P4 of the first coil 220 have substantially the same impedance. As shown in FIG. 2, the end points P3 and P4 of the first coil 220 respectively correspond to two points P3' and P4' on relative positions of the second coil 240. The points P3' and P4' are very close to each other on the second coil 240 compared to the length of the second coil 240, and a coil path length between the two points P3' and P4' is substantially equal to the distance d between the end points P3 and P4. Since the distance d is extremely small with respect to the coil path length between the point P3' and the end point S4 and the length between the point P4' and the end point S4, the coil path length between the point P3' and the end point S4 is regarded as being approximately equal to that between the point P4' and the end point S4. That is, a signal transmission length between the point P3' and the end point S4 is approximately equal to that between the point P3' and the end point S4. Therefore, although the end points S3 and S4 have different impedances, since the signal transmission distance between the point P3' and the end point S4 is approximately equal to that between the point P3' and the end point S4, the points P3' and P4' have approximately equal impedance values, so that the two end points P3 and P4 of the first coil 220 also have equal input impedance values. Therefore, when input signals having equal energy are respectively inputted to the first coil 220 via the end points P3 and P4, since the end points P3 and P4 have equal input impedances, the two input signals inducts equal energy into the first coil 220 via the end points P3 and P4. When the two input signals are processed via electromagnetic coupling of the first coil 220 and the second coil 240, two output signals having equal signal strength are outputted at the end point S4 of the first coil 240. As mentioned above, the transformer 20 can output signals having equal signal strength to overcome the drawback of the conventional transformer.

In order to obtain equal input impedance values at the two end points P3 and P4 of the first coil 220, in this embodiment, it is designed in a way that the first coil 220 is wound from the end point P3 at one outer side to a center point C3 at an inner side; and then, the first coil 220 is wound from the center point C3 to the end point P4 at another outer side. The second coil 240 coils from the end point S3 at an inner side to a center point C4 at an outer side, and the second coil 240 changes to coil from the center point C4 to the end point S4. In this manner, the point P3' becomes extremely close to the point P4', and a coil path length between the points P3' and P4' is approximately equal to the distance d between the end points P3 and P4. Since the distance d is very small compared to the coil path length between the point P3' and the end point S4 and the coil path length between the point P4' and the end point S4, the coil path length between the point P3' and the end point S4 is regarded as being equal to that between the point P4' and the end point S4. Therefore, even if the end points S3 and S4 have different impedance values, the end points P3 and P4 still have equal input impedance values. In another embodiment, the present invention also can be achieved by swapping coil patterns in the previous embodiment. That is, the first coil in this embodiment has the coil pattern of the second coil 240 in the FIG. 2, while the second coil has the coil pattern of the first coil in the FIG. 2. It is to be noted that, the way of coiling or winding does not limit the scope of the present invention, as long as the coil path length between the point P3' of the second coil 240 corresponding to the end point P3 of the first coil 220 and an output end point of the second coil 240 is approximately equal to that between the point P4' of the second coil 240 corresponding to the end point P4 of the first coil 220 and the output end point of the second coil 240. Or, the coil path length between the points P3' and P4' is approximately equal to the distance d between the end points P3 and P4. The transformer 20 in FIG. 2 is a planar transformer, that is, the first coil 220 and the second coil 240 are planar, and are on different planes. The planar transformer is suitable to integrate in a chip.

Figure 3:
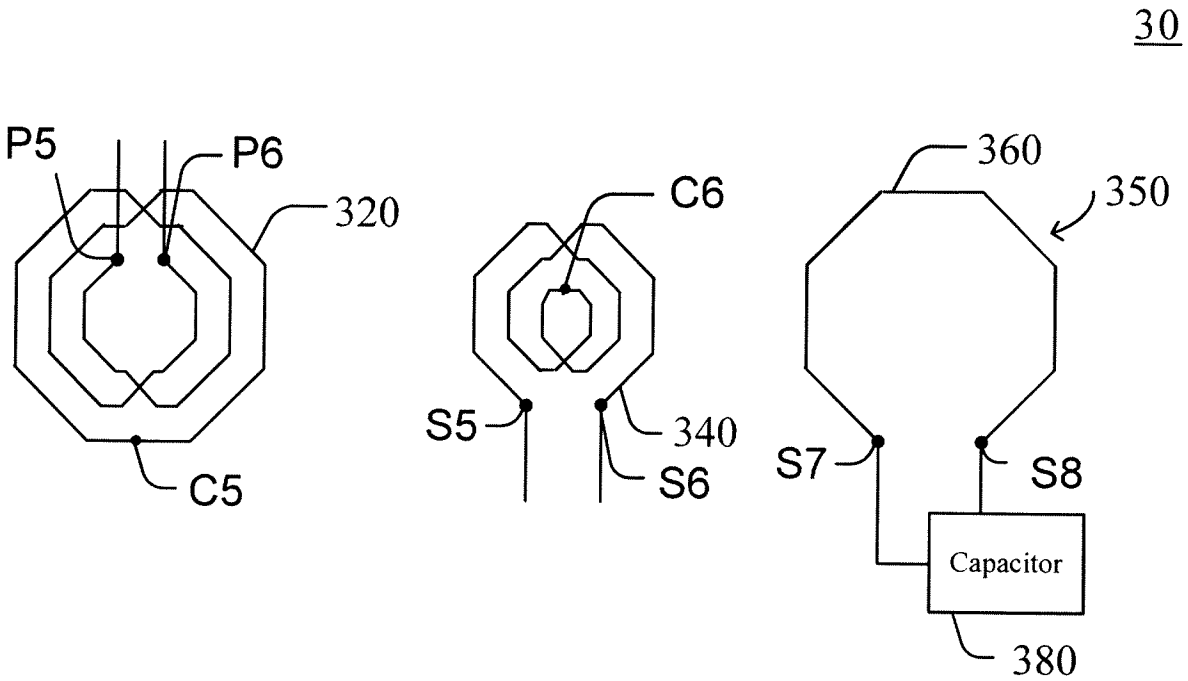
FIG. 3 is a schematic diagram of layout of a transformer of another embodiment of the present invention.

FIG. 3 is a schematic diagram of a configuration of a transformer 30 of another embodiment of the present invention. A transformer 30 comprises a first coil 320, a second coil 340, and a filter circuit 350 that comprises a filter coil 360 and a capacitor 380. The first coil 320 has two end points P5 and P6, and the second coil 340 has two end points S5 and S6. The filter coil 360 has two end points S7 and S8 for connecting the capacitor 38 in series.

In this embodiment, the filter circuit 350 of the transformer 30 is for adjusting an impedance value of the transformer 30 at a predetermined frequency. The filter coil 360 has impedance at the predetermined frequency such that signal coupling efficiency induced by the transformer is reduced; as a result, the components of one signal at the predetermined frequency are removed. Therefore, on top of bandpass characteristics, the transformer of the present invention also has a frequency conversion characteristic that is capable of removing undesired signals of the predetermined frequency.

Figure 4:
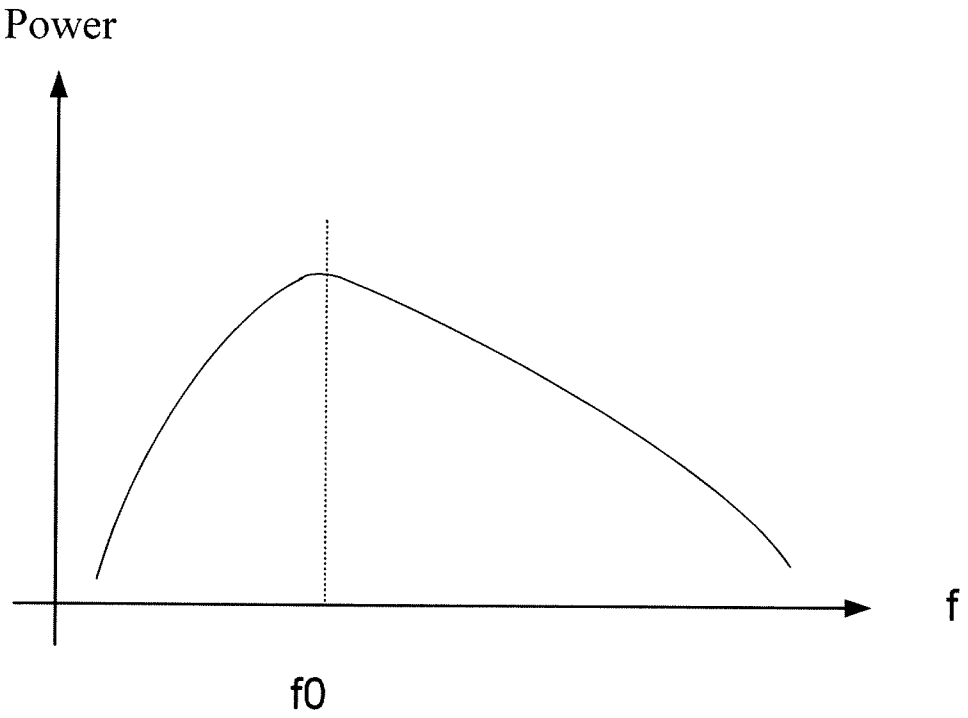
FIG. 4 is a schematic diagram of frequency conversion characteristics of a conventional transformer.
Figure 5:
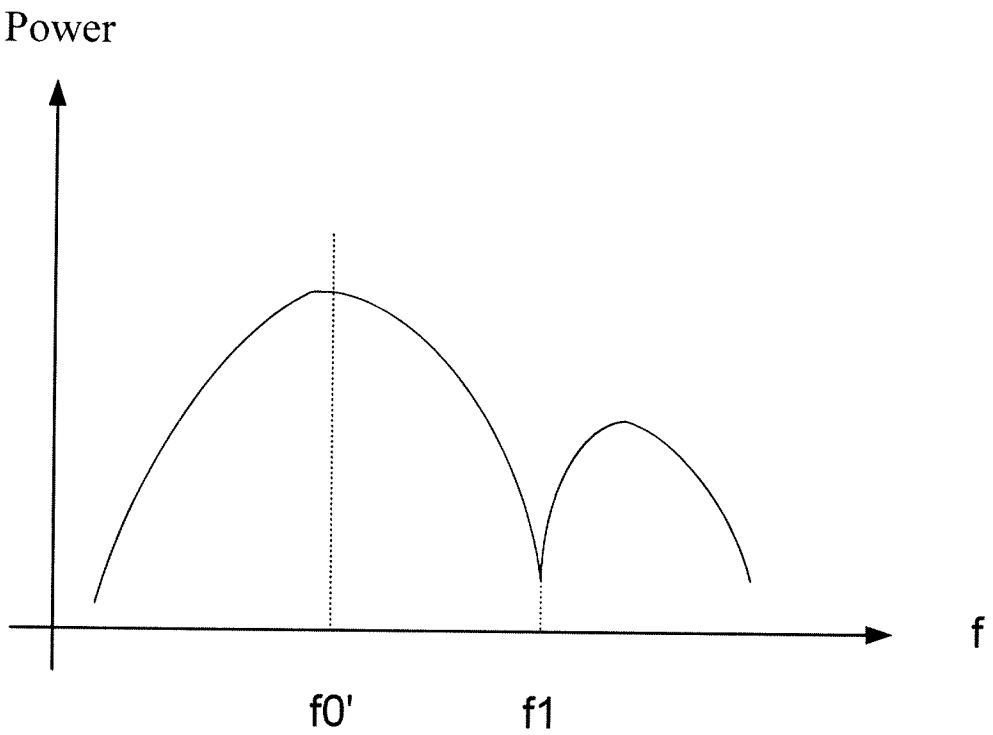
FIG. 5 is a schematic diagram of frequency conversion characteristics of a transformer of an embodiment of the present invention.

FIG. 4 is a schematic diagram of frequency conversion characteristics of a conventional transformer. The frequency conversion characteristics represent a relationship between signal strength and frequency after a signal is processed by the transformer. A frequency f0 is a resonant frequency among the first coil 320, the second coil 340 and ambient capacitors, where the first coil 320 and the second coil 340 have desired conversion characteristics at the frequency f0. FIG. 5 is a schematic diagram of frequency conversion characteristics of the transformer 30 of the embodiment of the present invention. Frequency f0' is a resonant frequency among the transformer and the ambient capacitors, and frequency f1 is a resonant frequency of series connection of the filter coil 360 and the capacitor 380. As shown in FIG. 5, impedance of the transformer 30 at the frequency f1 is very small, so that components of a signal at the frequency f1 are removed after having been processed via the transformer. It is to be noted that, the frequency f1 is adjustable by varying capacitance value and inductance value of the filter circuit 350. In other words, if an undesirable large noise signal at certain frequency exists, one can adjust the coupling effect of the filter circuit in order to remove the noise signal at that frequency. It is to be noted that, the value of frequency f1 shall not be construed as limiting the present invention.

As described above, the transformer of the present invention can change its impedance value at a predetermined frequency by appropriately adjusting the induction value of the filter coil 360 and the capacitance value of the capacitor 380. That is, according to the present invention, by appropriately adjusting the induction value of the filter coil 360 and the capacitance value of the capacitor 380, the transformer 30 results in having an impedance value of the transformer 30 at a frequency such that the noise signal at that frequency is filtered through the transformer 30. In other words, the transformer 30 generates a low-impedance at the frequency of the noise/undesired signal, such that the frequency conversion characteristics of the transformer 30 conforms to what is desired in filtering certain noises. For example, the frequency f1 at which the noise signal is to be removed by the filter circuit 350 is represented as $f1=1/2\pi\sqrt{L_{eff}C}$, where $L_{eff}$ is an equivalent inductance value of the filter coil 360, C is a capacitance value of the capacitor 380, i.e., the frequency f1 is inversely proportional to a product of the inductance value and the capacitance value.

In another embodiment of the present invention, when an end point of the second coil 340 is coupled to a fixed voltage, for example, an end point S5 is coupled to ground, the first coil 320 is wound from the end point P5 at the outer side to a center point C5 at the inner side, then is wound from the center point C5 to the other end point P6 at the outer side. The second coil 340 is wound from an outer-side end point S5 to an inner-side center point C6 then is wound to the end point S6 at another outer side. It is to be noted that, the foregoing coil patterns and the way of coiling or winding does not limit the scope of the present invention, as long as the coil path lengths from the output point on the second coil 340 to the two points on the second coil 340 are the same, where the two points on the second coil 340 are respectively corresponding to the end points P5 and P6 on the first coil 320.

Figure 6:
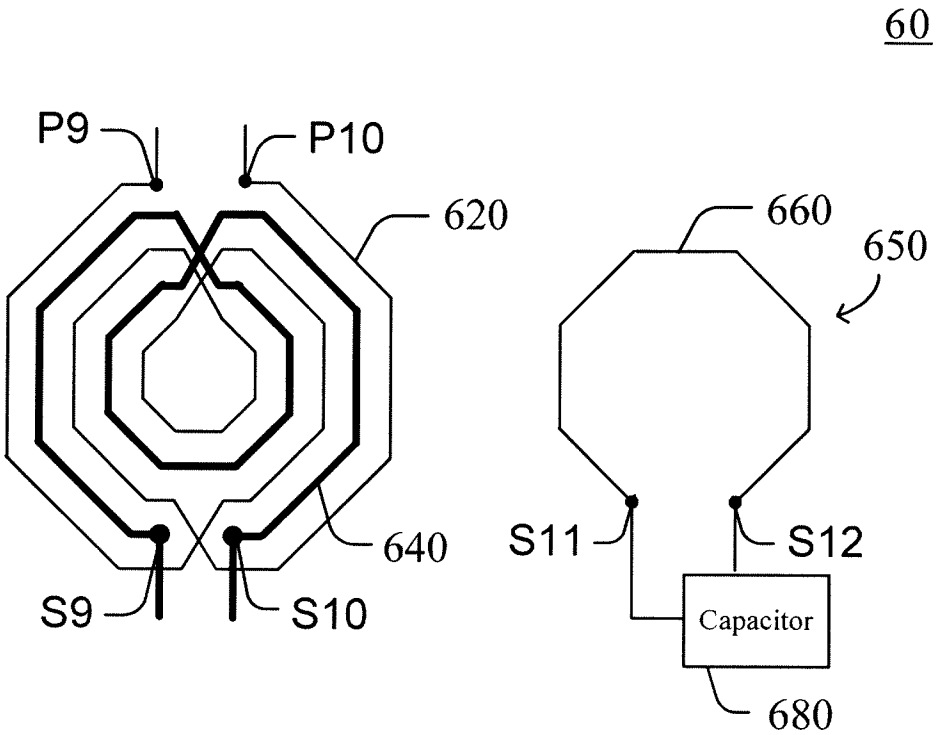
FIG. 6 is a schematic diagram of a layout of a transformer of another embodiment of the present invention.

In this embodiment, the first coil 320 and the second coil 340 are planar coils and are disposed on different planes. The filter coil 360 and one of the first coil 320 and the second coil 340 are on the same plane, or is on a plane parallel to and different from the planes of the first coil 320 and the second coil 340. A cover area of the filter coil 360 on its plane is overlapped with or mapped to the cover area of the first coil 320 or the second coil 340 on their respective planes. The transformer 30 shown in FIG. 3 is a planar transformer, that is, the first coil 320 and the second coil 340 are planar coils and are disposed on different planes. Therefore, the transformer 30 can be applied as an on-chip transformer. In other embodiments, the transformer of the present invention may also be an interleaving transformer as shown in FIG. 6. FIG. 6 shows a schematic diagram of a configuration of the interleaving transformer. The transformer 60 comprises a first coil 620, a second coil 640, and a filter circuit 650, which comprises a filter coil 660 and a capacitor 680. The first coil 620 and the second coil 640 of the transformer 60 are interleaved with each other on the same plane. In this embodiment, the filter coil 660 can be on a same plane or a different plane relative to the coils 620 and 640. A cover area by the filter coil 660 on the plane can be mapped to the planes of the first coil 620 or second coil 640 and overlapped with cover area of the first coil 620 or the second coil 640 on their planes.

When the conventional transformer is used in a transmitter of a communication system, input and output energy conversion relationship has bandpass characteristics. However, since circuits of the transmitter are non-ideal, on top of a to-be-transmitted signal, undesired components of signals created by the non-ideal circuits (such as second-order harmonic signals of the to-be-transmitted signal) are transmitted. Therefore, frequencies of the undesired signals fall within a bandpass bandwidth of the filter, the undesired components of signals are converted to the output end, such that the transmitter needs to additionally remove the undesired signals.

Figure 7:
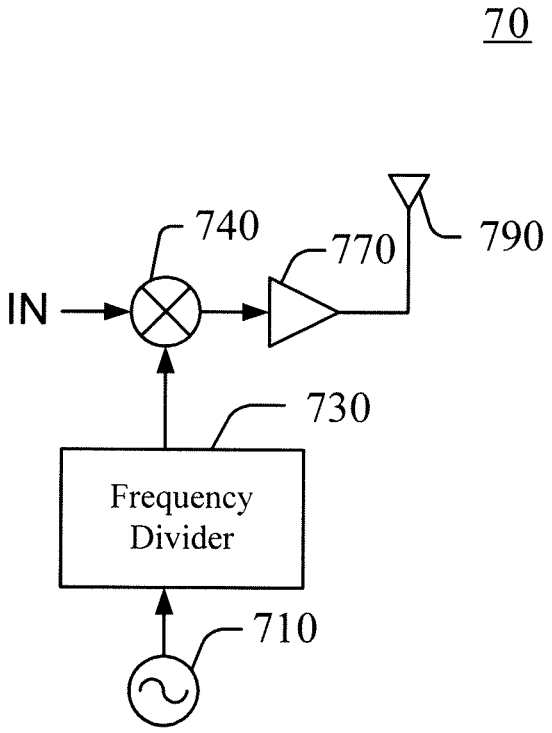
FIG. 7 is a function block diagram of a transmitter of a transformer of an embodiment of the present invention.

To address this issue, embodiments of the present invention, such as the transformer 20, 30 and 60 mentioned above, may be employed in a transmitter of a communication system. FIG. 7 is a block diagram of functions of the transmitter of an embodiment of the transformer of the present invention. Transmitter 70 comprises a voltage-controlled oscillator (VCO) 710, a frequency dividing circuit 730, a mixer 740, a power amplifier (PA) 770 and an antenna 790.

A voltage of the VCO 710 is appropriately controlled to generate a signal having a desired frequency, represented as 2*f*. The signal is frequency divided by the frequency dividing circuit 730 to generate a local oscillation (LO) signal, and a frequency of the LO signal is represented as f, for example. An input signal IN and the LO signal generated by the frequency dividing circuit 730 is mixed via the mixer 740 to generate a synthesized signal. After the synthesized signal is amplified by the power amplifier, the synthesized signal is outputted via the antenna 790.

In an embodiment, the transformer 20 can be applied to the mixer 740 of the transmitter 70 to simplify an impedance matching circuit of the mixer 740. Since the transformer 20 can output signals with approximately equal signal strength, in the event that the transformer 20 is applied to the mixer 740, no additional impedance matching circuit is needed. Therefore, a less difficult and complex circuit design as well as less cost and circuit size may be realized in the embodiment of the present invention.

For example, assume that the VCO 710, the frequency dividing circuit 730 and the mixer 740 are on-chip components, and power amplifier 770 and the antenna 790 are off-chip components, because the transformer 20 can output signals having equal signal strength, an inexpensive or low-performance power amplifier 770, such as a single-in-single-out (SISO) power amplifier, can be applied to reduce cost of the transmitter 70.

In an embodiment, the transformers 30 and 60 are applied to the mixer 740 of the transmitter 70 to reduce the second-order harmonic signal interference of the transmitter 70. Since circuits of the transmitter 70 are non-ideal, on top of a to-be-transmitted signal, second-order harmonic signals of the to-be-transmitted signal created by the non-ideal circuit are transmitted. When the to-be-transmitted signal of the transmitter 70 becomes larger, the second-order harmonic signals of the transmitter become larger. Large second-order harmonic signals will cause interference to a circuit having an on-chip inductor, e.g., the VCO 710, and even an output frequency of the VCO may be changed. The transformer 30 or 60 provided by the present invention defines the to-be-removed-signal frequency f1 as being equal to a frequency of a second-order harmonic signal of the to-be-transmitted signal, i.e., supposing that the frequency of the to-be-transmitted signal is f0', f1=2f0', power of the second-order harmonic signal is reduced to prevent the transmitter 70 from being interfered by the second-order harmonic signals.

In conclusion, the conventional transformer for performing energy conversion can neither output output signals having equal energy nor remove undesired signals. Therefore, according to the present invention, a transformer capable of outputting output signals having equal energy as well as removing undesired signals is provided.

While the invention has been described in terms of what is presently considered to be the most practical and preferred embodiments, it is to be understood that the invention needs not to be limited to the above embodiments. On the contrary, it is intended to cover various modifications and similar arrangements included within the spirit and scope of the appended claims which are to be accorded with the broadest interpretation so as to encompass all such modifications and similar structures.

What is claimed is:

1. A transformer, comprising:

a first substantially octagonally-shaped planar coil having a plurality of successive vertices defined by respective angled intersections of adjacent segments of the first planar coil, having two input ends disposed, respectively, at two of the successive vertices of the first planar coil, with a distance between the two input ends, wherein each input end is in electrical communication with a series of adjacent segments and successive vertices that complete two full turns; and a second planar coil, having two output ends disposed at a side substantially opposite the two input ends;

wherein, the second planar coil has two points relative to the two input ends of the first planar coil, and an exclusively planar coil path length between the two points on the second planar coil is substantially equal to the distance of the two input ends, and wherein the two points on the second planar coil relative to the two input ends of the first planar coil have substantially equal impedances, such that two input signals at the two input ends inducts equal energy at the two points on the second planar coil and the two output ends produce two output signals with substantially equal signal strengths.

2. The transformer as claimed in claim 1, wherein the transformer is an on-chip transformer.

3. The transformer as claimed in claim 2, wherein the first planar coil is wound in a first direction from one of the two input ends to a first center point, and wound in a second direction from the first center point to the other of the two input ends, and the second planar coil is wound in the second direction from one of the output ends to a second center point, and wound in the first direction from the second center point to the other of the two output ends.

4. The transformer as claimed in claim 2, wherein the first planar coil and the second planar coil are disposed on different planes respectively.

5. The transformer as claimed in claim 1, further comprising a filter circuit, for adjusting an impedance value of the transformer at a predetermined frequency to remove components of a signal at the predetermined frequency.

6. The transformer as claimed in claim 5, wherein the filter circuit comprises a filter coil and a capacitor.

7. The transformer as claimed in claim 1, wherein one of the two output ends of the second planar coil is at a fixed voltage.

8. The transformer as claimed in claim 1, wherein the respective successive vertices of the first planar coil are outer vertices of the first planar coil.

9. The transformer as claimed in claim 1, wherein the second planar coil is substantially octagonally-shaped.

10. The transformer as claimed in claim 9, wherein the two output ends are disposed at respective successive vertices of the second planar coil.

11. The transformer as claimed in claim 10, wherein the successive vertices of the second planar coil are inner vertices of the second planar coil.

* * * * *